US010040075B2

(12) United States Patent
Jameson

(10) Patent No.: US 10,040,075 B2
(45) Date of Patent: Aug. 7, 2018

(54) METHOD AND APPARATUS FOR FLOTATION IN A FLUIDIZED BED

(71) Applicant: Graeme John Jameson, Callaghan (AU)

(72) Inventor: Graeme John Jameson, Callaghan (AU)

(73) Assignee: THE UNIVERSITY OF NEWCASTLE RESEARCH ASSOCIATES LIMITED (AU)

( * ) Notice: Subject to any disclaimer, the term of this patent is extended or adjusted under 35 U.S.C. 154(b) by 584 days.

(21) Appl. No.: 14/804,505

(22) Filed: Jul. 21, 2015

(65) Prior Publication Data

US 2015/0321202 A1 Nov. 12, 2015

Related U.S. Application Data

(62) Division of application No. 12/528,531, filed as application No. PCT/AU2008/000252 on Feb. 26, 2008, now Pat. No. 9,085,000.

(30) Foreign Application Priority Data

Feb. 26, 2007 (AU) ..... 2007900962

(51) Int. Cl.
*B03D 1/24* (2006.01)
*B03D 1/02* (2006.01)
(Continued)

(52) U.S. Cl.
CPC ..... *B03D 1/24* (2013.01); *B03D 1/02* (2013.01); *B03D 1/028* (2013.01); *B03D 1/082* (2013.01);
(Continued)

(58) Field of Classification Search
None
See application file for complete search history.

(56) References Cited

U.S. PATENT DOCUMENTS 1,973,278 A 9/1934 Barker et al.
2,226,170 A 12/1940 Lasseter
(Continued)

FOREIGN PATENT DOCUMENTS

CA 2140305 7/1996
SU 1282908 1/1987
(Continued)

OTHER PUBLICATIONS

International Search Report dated Apr. 23, 2008, issued in corresponding international application No. PCT/AU2008/000252.
(Continued)

*Primary Examiner* — Thomas M Lithgow
(74) *Attorney, Agent, or Firm* — Ostrolenk Faber LLP

(57) ABSTRACT

Separation of hydrophobic particles from a mixture of particles in a fluid is performed by providing a fluidized bed as a relatively non-turbulent contacting mechanism in a flotation cell incorporating a settling chamber located immediately above the fluidized bed. Hydrophobic particles attach to bubbles in the fluidized bed and rise to the interface with the settling chamber where non-hydrophobic particles flow over the lip of an internal launder and are removed as tailings at. The hydrophobic particles attached to bubbles float upwardly in the relatively placid settling chamber where unwanted gangue can fall back to interface. The bubbles form a froth layer at the upper surface of the settling chamber, and flow over the launder lip carrying the hydrophobic particles. An operation of the apparatus is kept stable by recirculating fluid from the settling chamber via pip and pump to mix with new feed entering at duct.

8 Claims, 6 Drawing Sheets

(51) Int. Cl.
*B03D 1/08* (2006.01)
*B03D 1/14* (2006.01)

(52) U.S. Cl.
CPC ..... *B03D 1/1456* (2013.01); *B03D 1/1468* (2013.01); *B03D 1/1475* (2013.01); *B03D 1/242* (2013.01); *B03D 1/14* (2013.01); *B03D 1/1493* (2013.01); *B03D 1/247* (2013.01)

(56) References Cited

U.S. PATENT DOCUMENTS

| | | | | |
|---|---|---|---|---|
| 2,778,499 | A | 1/1957 | Alfre et al. | |
| 2,783,884 | A | 3/1957 | Schaub | |
| 4,472,271 | A | 9/1984 | Bacon, Jr. | |
| 4,960,509 | A | 10/1990 | McNeill | |
| 4,981,582 | A | 1/1991 | Yoon et al. | |
| 5,249,688 | A | 10/1993 | Hwang | |
| 5,397,001 | A | 3/1995 | Yoon et al. | |
| 5,431,286 | A | 7/1995 | Xu et al. | |
| 5,551,574 | A | 9/1996 | Hicks et al. | |
| 5,591,328 | A | 1/1997 | Bodnaras | |
| 5,746,910 | A | 5/1998 | Negeri | |
| 6,082,548 | A * | 7/2000 | Stephenson | B03B 5/623 134/25.1 |
| 6,425,485 | B1 | 7/2002 | Mankosa et al. | |
| 2004/0089595 | A1 | 5/2004 | Kujawa | |

FOREIGN PATENT DOCUMENTS

| | | |
|---|---|---|
| WO | WO 2001/066259 | 9/2001 |
| WO | WO 2002/072456 | 9/2002 |
| WO | WO 2006/056018 | 6/2006 |

OTHER PUBLICATIONS

Kohmuench, J.N. 2000. "Improving. Efficiencies in Water-Based Separators Using Mathematical Analysis Tools," Doctoral Dissertation Virginia Polytechnic Institute and State University, Blacksburg, Virginia, published Dec. 2000.

Zhang et al., 2002. "Beneficiation of Phosphates", Society for Mining, Metallurgy, and Exploration, Inc., Published in 2002 and Presented at Engineering Foundation Conference on the Beneficiation of Phosphates held at St. Pete Beach, Florida in 2002.

Kohmuench, J.N. et al. "The HydroFloat Separator: A New Technology for Recovering Coarse Phosphate Sands", Published in 2005 and presented at the Centenary of Flotation Symposium held in Brisbane, Australia in 2005.

Mankosa et al. "Testing of the Hydrofloat Cell for Recovery of Coarse Phosphate", Presented at the Engineering Foundation Conference on the Beneficiation of Phosphate at Palm Coast, Florida in 1998.

Kohmuench J.N. et al. "Implementation of the HydroFloat technology at the South Fort Meade Mine", Minerals & Metallurgical Processing, published Nov. 2007.

Heiskanen, K. "Particle Classification", published 1993.

Kuni and Levenspiel, "Fluidisation Engineering", published 1968.

Notice of Opposition by Eriez Manufacturing Co., dated Oct. 12, 2012 for Australian Patent Application No. 2008221231 in the name of Newcastle Innovation Limited.

Statement of Grounds and Particulars of Opposition dated Jan. 8, 2013 in the matter of Australian Patent Application No. 2008221231 in the name of Newcastle Innovation Limited and in the matter of Opposition thereto by Eriez Manufacturing Co.

Executed Statutory Declaration of Clinton Priddle dated Apr. 8, 2013 in the matter of Australian Patent Application No. 2008221231 in the name of Newcastle Innovation Limited and in the matter of Opposition thereto by Eriez Manufacturing Co.

Executed Statutory Declaration of Jaisen Kohmuench dated Jun. 6, 2013 in the matter of Australian Patent Application No. 2008221231 in the name of Newcastle Innovation Limited and in the matter of Opposition thereto by Eriez Manufacturing Co.

Marked-up Statement of Grounds and Particulars of Opposition dated Jun. 7, 2013 in the matter of Australian Patent Application No. 2008221231 in the name of Newcastle Innovation Limited and in the matter of Opposition thereto by Eriez Manufacturing Co.

Smooth Statement of Grounds and Particulars of Opposition dated Jun. 7, 2013 in the matter of Australian Patent Application No. 2008221231 in the name of Newcastle Innovation Limited and in the matter of Opposition thereto by Eriez Manufacturing Co.

Executed Statutory Declaration of Ernest Graf dated Jun. 7, 2013 in the matter of Australian Patent Application No. 2008221231 in the name of Newcastle Innovation Limited and in the matter of Opposition thereto by Eriez Manufacturing Co.

Executed Declaration of Glen Oswald dated Jul. 5 2013 in the matter of Australian Patent Application No. 2008221231 in the name of Newcastle Innovation Limited and in the matter of Opposition thereto by Eriez Manufacturing Co.

Executed Declaration of Tim Napier-Munn dated Oct. 8, 2013 in the matter of Australian Patent Application No. 2008221231 in the name of Newcastle Innovation Limited and in the matter of Opposition thereto by Eriez Manufacturing Co.

Executed Declaration of Jaisen Kohmuench dated Dec. 17, 2013 in the matter of Australian Patent Application No. 2008221231 in the name of Newcastle Innovation Limited and in the matter of Opposition thereto by Eriez Manufacturing Co.

Executed Declaration of Gerald H. Luttrell dated Dec. 17, 2013 in the matter of Australian Patent Application No. 2008221231 in the name of Newcastle Innovation Limited and in the matter of Opposition thereto by Eriez Manufacturing Co.

Executed Declaration of Norman Epstein dated Dec. 18, 2013 in the matter of Australian Patent Application No. 2008221231 in the name of Newcastle Innovation Limited and in the matter of Opposition thereto by Eriez Manufacturing Co.

Opponent's Summary of Submissions dated May 6 2014 in the matter of Australian Patent Application No. 2008221231 in the name of Newcastle Innovation Limited and in the matter of Opposition thereto by Eriez Manufacturing Co.

Outline of Submissions for Newcastle Innovation Limited dated May 13, 2014 in the matter of Australian Patent Application No. 2008221231 in the name of Newcastle Innovation Limited and in the matter of Opposition thereto by Eriez Manufacturing Co.

Decision dated Aug. 12, 2014 in corresponding Australian Patent Application No. 2008221231.

* cited by examiner

METHOD AND APPARATUS FOR FLOTATION IN A FLUIDIZED BED

CROSS REFERENCE TO RELATED APPLICATIONS

The present application is a divisional under 37 C.F.R. § 1.53(b) of prior U.S. patent application Ser. No. 12/528,531, filed Aug. 25, 2009, which in turn is a U.S.C. § 371 National Phase conversion of PCT/AU2008/000252, filed Feb. 26, 2008, which claims priority of Australian Application No. 2007900962, filed Feb. 26, 2007. The contents of each of these applications are incorporated in full by reference herein.

FIELD OF THE INVENTION

This invention relates to the froth flotation process for the separation of particles. In particular it relates to improving the recovery of coarse particles in froth flotation machines.

BACKGROUND OF THE INVENTION

Froth flotation is a known process for separating valuable minerals from waste material, or for the recovery of finely-dispersed particles from suspensions in water. Typically, an ore as mined consists of a relatively small proportion of valuable mineral disseminated throughout a host rock of low commercial value (gangue). The rock is crushed or finely ground so as to liberate the valuable particles (values). The finely-ground particles are suspended in water, and reagents may be added to make the surfaces of the values non-wetting or hydrophobic, leaving the unwanted gangue particles in a wettable state. Air bubbles are then introduced into the suspension, which is also referred to as pulp or slurry. A frother may be added to assist in the formation of fine bubbles and also to ensure that a stable froth is formed as the bubbles rise and disengage from the liquid.

In the flotation cell, the values adhere to the bubbles, which carry them to the surface and into the stable froth layer. The froth discharges over the lip of the cell, carrying the values. The waste gangue remains in the liquid in the cell and is discharged with the liquid to a tailings disposal facility. The primary purpose of the flotation process is to separate or remove selected particles, that are either naturally hydrophobic or can be caused to be hydrophobic by appropriate addition of reagents (conditioning), from a mixture of hydrophobic and non-hydrophobic particles (mixed particles), in a suspension in water.

The formation of a froth layer is an important characteristic of the froth flotation process. In a stable froth layer, froth is discharged over the lip of the flotation cell, being continuously replaced by bubbles with attached particles, and entrained particles, from the pulp or slurry in the cell beneath. While moving towards the overflow lip, the froth drains and entrained particles are able to flow back into the pulp, enhancing the purity or grade of the flotation product.

It is recognised that there is a limit to the size of particles that respond well to flotation. Above a certain size, which is of the order of 100 microns for particles of base metal sulfides, or 350 microns for coal particles, the recovery of particles in a flotation cell decreases, as the particle size increases. We refer to such particles as "coarse" particles.

It is well established that coarse particles are difficult to float because of the effect of turbulence in the flotation machines in current use. In mechanical cells, the particles are kept in suspension by the action of a rotating impeller in the base of the cell. The impeller is also used to disperse an air flow into bubbles which are essential for the flotation process. By its very nature, the impeller causes the motion of the fluid in the cell to be highly turbulent in nature, characterised by the existence of vortices or eddies with a wide range of diameters and rotational speeds. In flotation columns, turbulent motions arise from convection currents established by bubbles rising through the liquid in the column. In both these examples, when a bubble is trapped in the centre of an eddy, it will rotate at the rotational frequency of the eddy, and if a large particle above a certain critical size is attached to the bubble, it will be flung away by centrifugal force that ruptures the bubble-particle aggregate. A theory exists for calculating the maximum floatable diameter of a particle with known physical properties (Schulze, H J (1977). New theoretical and experimental investigations on stability of bubble/particle aggregates in flotation: a theory on the upper particle size of floatability. Int. J. Miner. Process., 4, 241-259. See also Schulze H J (1982). Dimensionless number and approximate calculation of the upper particle size of floatability in flotation machines. Int. J. Miner. Process., 9, 321-328.)

It is clear that existing technologies have a severe limitation in regard to their ability to recover coarse particles. There is a need for a way of conducting flotation that substantially eliminates turbulence from the environment in which the capture of particles by bubbles is performed. It is an object of the present invention to reduce turbulence in a flotation cell.

A number of terms relating to the phenomenon of fluidization are now defined, with reference to a vertical cylindrical column, containing solid particles and a liquid such as water. A stream of liquid containing particles in suspension flows upwards in the column, being distributed uniformly across the entry plane at the base. The feed flowrate is kept constant, while the diameter or cross-sectional area of the column is allowed to change. The concentration of particles in the feed stream is such that the particles are free to move relative to each other, and the volume fraction of particles in the feed is lower than the volume fraction of solids in a packed bed, which is typically of the order of 0.4. (A packed bed forms when solids are allowed to settle in a stationary liquid layer in the column, i.e. where there is no entry of fresh liquid.) When the area of the column is large, the upward velocity of the liquid is very low, and the particles settle against the rising liquid. (The velocity here is the superficial velocity, which is the volumetric flowrate of liquid (or water or solid particles as appropriate) divided by the horizontal cross-sectional area of the column.) A bed of particles, in which each particle is supported by the adjacent particles with which it is in contact, moves slowly up the column. This is referred to as a moving bed. If the column area is further reduced, the particles in the bed still tend to settle against the upward flow of liquid in the feed stream. Across the bed in the vertical direction, a frictional pressure drop is created due to the relative velocity between the particles and the liquid. At a certain liquid velocity, the pressure drop becomes sufficient to support the effective mass of all the particles, so that each particle is supported by the upward motion of the liquid, rather than by the adjacent particles. The superficial liquid velocity at which this occurs is referred to as the minimum fluidization velocity. With further reduction in column area, the particles move further apart. The volume fraction of solids is less than that in a packed bed, and an expanded fluidized bed or expanded bed is created. As the column area is reduced still further, the solids volume fraction decreases further, until it equals the volume fraction in the feed flow. In a related phenomenon in a fluidized bed where there is no net inflow of particles, when the liquid velocity is less than the terminal velocity of the particles, they will stay in the enclosing vessel and a static bed is formed, which may or may not be in an expanded state. When the upward liquid velocity exceeds the terminal velocity of the particles, they are entrained into the flow, the basis of the process known as elutriation.

An important concept in fluidization studies is that of slip, by which is meant the difference in the superficial velocities of the suspending fluid and the solid particles. Consider the system above in which there is a continuous feed of solids and water to the column. The feed is relatively dilute, so the volume fraction of solids is much less than the volume fraction that would exist in a packed bed of the same solids. If there is a large superficial velocity difference between the solids and the liquid, giving a high slip velocity, the particles will accumulate in the bed, and the solids volume fraction will increase, with corresponding drop in liquid fraction. The liquid fraction represents the fraction of the cross-section of the bed that is available for the through-flow of the liquid. Thus an increase in solids fraction leads to a reduction in the flow area available to the liquid, and hence to an increase in the drag force exerted on the particles which leads ultimately to the formation of a fluidized bed. In a steady state operation, the solids fraction in the bed when it is fluidized will be higher than the solids fraction in the feed flow. When the particles are very small so that their terminal settling velocity is much lower than the liquid velocity in the bed, there will be very little slip between the liquid and the particles, so the solids fraction in the column will be essentially the same as the solids fraction in the feed. Such a flow in the column is referred to as a co-current flow. In a co-current flow, all the particles in the suspension flow upwards with the liquid.

A spouted bed is a bed of particles through which a vertical rising jet of fluid is injected centrally through the base of the bed. To form a spout, the entering fluid must exceed a minimum spouting velocity. In steady-state operation, a circulation pattern is established in the bed in which the solids entrained by the fast-moving entrance jet rise upwards. If the bed is relatively shallow, the jet actually penetrates the upper surface of the bed, and particles rise above this surface and fall back on the annular area surrounding the jet. If the bed of particles is deep, a recirculating spouted bed may form in the base of the bed, and rise to a certain height (the maximum spout height) before its energy is spent, and a normal fluidized bed forms above the spouted zone. Spouted beds may form in a simple right cylinder with a flat base, in a right cylinder with a conical base, or in a cone.

For purposes of this specification, liquid generally has the meaning of a liquid alone, such as water, or it may on occasion refer to a dilute suspension of solids in water. A concentrated suspension of particles in a supporting liquid such as water is referred to as a slurry or pulp. If a pulp is flowing in a pipe at a certain flowrate, it is clear that there will be corresponding flowrates of the constituent components, the liquid and the solids. Where it is necessary to distinguish between the liquid and the solids in a feed or a fluidized bed, the liquid component of the slurry will be described as water. Fluid has the meaning of anything that flows, including a gas such as air, a liquid such as water, and a suspension of particles in a liquid, such as the feed suspension of particles that is fed to a flotation cell. Because of the slip that exists in a fluidized bed, the superficial velocity of the particles in the bed relative to space is generally different to that of the supporting liquid, which is generally water.

There are a number of prior inventions that have attempted to improve the recovery of coarse particles in flotation. McNeill (U.S. Pat. No. 4,960,509) modified a mechanical flotation cell by the incorporation of a vertical baffle that divided the cell into two compartments, a feed zone and a flotation zone. A pulp of crushed ore suspended in water passes from the feed zone through an impeller where it is brought into contact with air bubbles. The aerated pulp then rises through a perforated plate towards the top of the cell, where the bubbles disengage from the liquid and pass into the froth layer, carrying any attached particles with them. The impeller in the cell has the dual function of breaking up the air stream into small bubbles, and also of keeping the particles in the feed in suspension, so that they do not sediment in the bottom of the cell. This device suffers from an important deficiency in relation to the flotation of coarse particles, since it depends on the suspending action of the impeller, which will inevitably introduce high energy-dissipation rates throughout the flotation cell, and create high levels of turbulence that will cause coarse particles to detach from the bubbles. To maximise coarse particle recovery it is preferable to do away with rotating impellers or any device that will create high levels of turbulence in locations where such particles can be detached from bubbles. It is an object of the present invention to create an environment that is conducive to capture and retention of coarse particles and which does not require mechanical agitation.

U.S. Pat. No. 6,425,485 (Mankosa et al) describes a hydraulic separator in which the density of one type of particle is decreased by the adherence of air bubbles, thereby facilitating the separation of such particles from others of higher density, in a fluidized bed separator. The invention is in effect an extension of a device in common use for gravity separation, known as the teeter bed separator. A feed containing particles in suspension is introduced near the top of a rectangular cell. Provision is made to withdraw solids and liquid from a dewatering cone at the base of the cell, and also from a collection launder at the top of the cell. A fluidized bed known as a teeter bed forms in the cell, so that particles whose density is less than the average density of particles in the bed float to the top. The teeter bed is fluidized with fresh water, into which air bubbles are injected. The bubbles attach to any particles in the bed that are hydrophobic, and carry them to the surface of the vessel and into the collection launder, along with any materials of low density that may exist in the feed. The device is described in terms of its ability to separate particles on the basis of their density. However, this invention has severe limitations if used for flotation. As noted, there are two slurry discharge streams, one out of the bottom of the cell and the other out of the top. Whether or not there are hydrophobic particles in the feed to the cell, the lighter particles will be removed at the top of the vessel. If the feed contains hydrophobic particles that will attach to bubbles, they too will flow out of the top of the vessel, mixed with low-density hydrophilic particles. In flotation, it is desired to separate the hydrophobic particles from the hydrophilic particles, and the Mankosa device cannot do this. The inability to distinguish between particles that arrive in the collection launder because they are of lower density than those in the underflow discharge, and those that are present because they are hydrophobic and have become attached to air bubbles, is a very severe limitation from the point of view of the flotation process. Another weakness of this invention is the necessity to use clean water as the fluidizing fluid. In many mining locations, water is scarce and costly and it is desirable to minimize the clean water requirements of any mineral processing operation.

SUMMARY OF THE INVENTION

In one aspect the present invention provides a method of separating selected particles from a mixture of particles in a fluid, including the steps of:

- feeding the mixed particles and fluid into a fluidized bed containing bubbles;
- allowing the selected particles to attach to bubbles within the fluidized bed and rise to the top of the fluidized bed;
- allowing bubbles with selected particles attached to rise above the fluidized bed into a settling chamber while removing other particles from the fluidized bed as tailings;
- forming a froth layer of bubbles and attached selected particles at the top of the settling chamber; and
- removing the selected particles with bubbles from the froth layer.

Preferably, the fluidized bed is arranged and controlled such that the bubbles with selected particles attached reach the top of the fluidized bed in a gentle non-turbulent manner.

Preferably, the selected particles are hydrophobic or conditioned to cause them to be hydrophobic and attach to the bubbles.

Preferably, recycle fluid is removed from the settling chamber and pumped into the feed of mixed particles and fluid by a recycle pump.

In one form of the invention the bubbles are formed in an aerator downstream of the recycle pump.

In a further aspect the present invention provides an apparatus for separating selected hydrophobic particles from a mixture of particles in a fluid, said apparatus including:

- a fluidization chamber arranged to receive a feed of a mixture of particles and fluid into the lower part of the chamber;
- fluidization means arranged to supply bubbles and feed into the chamber at such a rate that a fluidized bed of particles is formed within the fluidization chamber;
- a settling chamber located directly above and communicating with the fluidization chamber such that selected hydrophobic particles attached to bubbles rising to the top of the fluidized bed float upwardly within the settling chamber;
- tailings separation means arranged to remove non-hydrophobic particles from the fluidized bed; and
- an overflow launder at the top of the settling chamber arranged to remove the selected hydrophobic particles from a froth layer formed at the top of the flotation cell.

Preferably, a recycle duct and pump is provided arranged to remove fluid from the settling chamber and recycle it with the feed into the lower part of the fluidization chamber.

Preferably, an aerator is provided in the recycle duct, providing a source of bubbles into the feed.

In one form of the invention the tailings separation means comprises an internal launder between the fluidization chamber and the settling chamber.

In an alternative form of the invention the tailings separation means comprises an air lift pump incorporating an uplift tube having its lower end located at the interface of the top of the fluidization chamber and the bottom of the settling chamber.

In one embodiment the lower end of the fluidization chamber is tapered inwardly and downwardly in the shape of an inverted cone, and the fluidization means include apparatus arranged to propel the feed upwardly from the apex of the inverted cone, forming a spouted jet within the lower part of the fluidization chamber.

In another embodiment the fluidization chamber is provided with a vertically extending draft tube located just above the apex of the inverted cone and arranged to guide the spouted jet upwardly in a non-turbulent manner.

In another embodiment the lower end of the fluidization chamber is tapered inwardly and downwardly in the shape of an inverted cone, and the fluidization means include an apparatus arranged to supply the feed into the fluidization chamber at the apex of the inverted cone, and wherein bubbles are introduced into the lower part of the fluidization chamber by providing a downcomer extending downwardly through the settling chamber and the fluidization chamber to a point above the apex of the inverted cone, the upper end of the downcomer incorporating a nozzle and an air supply, the apparatus further including a duct arranged to remove fluid from the settling chamber and a pump arranged to pump fluid through that duct under pressure into the top end of the downcomer where the fluid is forced under pressure through the nozzle forming a downwardly plunging jet entraining air from the air supply and feeding the resultant bubbly mix downwardly through the downcomer to issue into the fluidized bed adjacent the apex of the inverted cone where it mingles with the feed.

BRIEF DESCRIPTION OF THE DRAWINGS

The invention will now be described with reference to the accompanying drawings in which.

DETAILED DESCRIPTION OF THE PREFERRED EMBODIMENT OF THE INVENTION, AND VARIATIONS THEREOF

Figure 1:
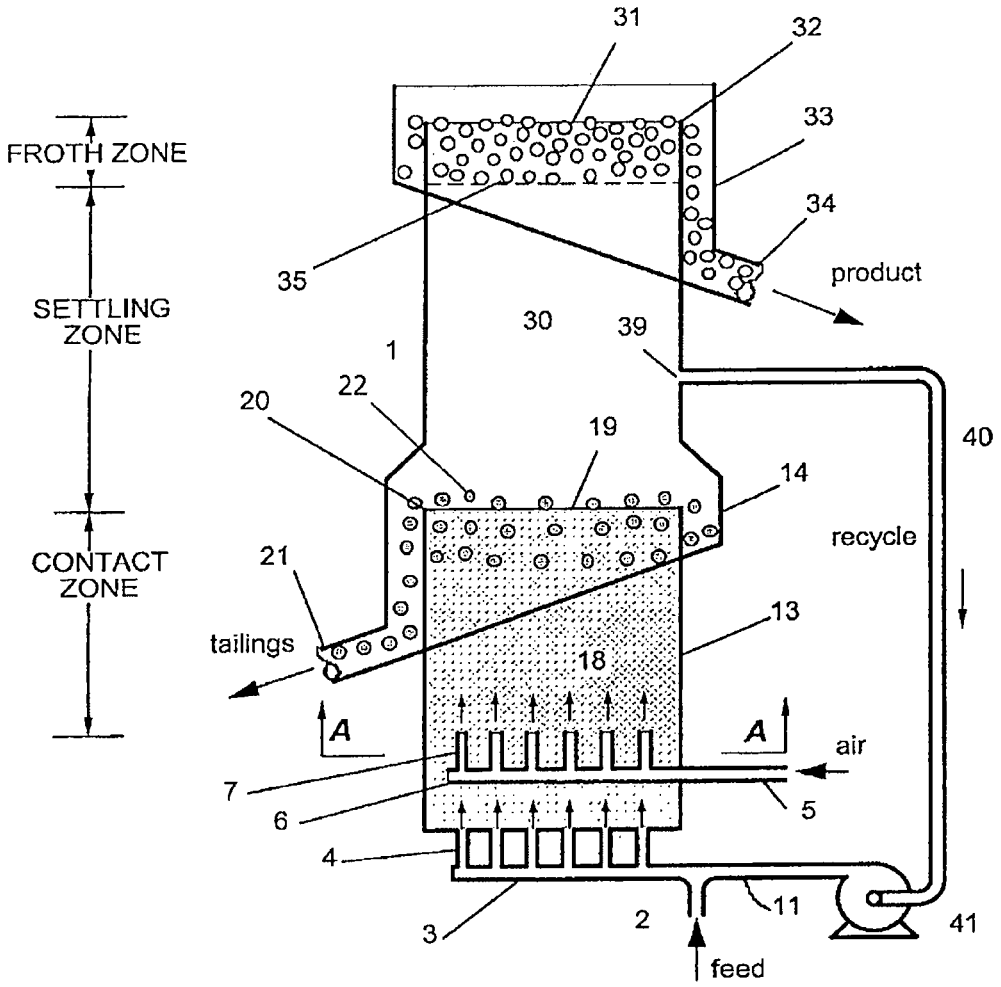
FIG. 1 is a schematic cross-sectional elevation of a flotation device according to the invention.
Figure 2:
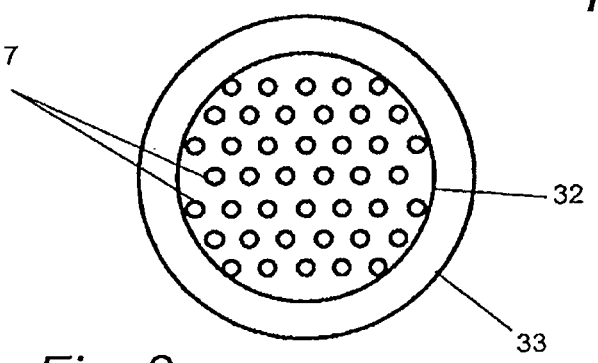
FIG. 2 is a cross-sectional plan view on the line A-A of FIG. 1.

FIGS. 1 and 2 show a cross-sectional elevation and a plan view respectively, of a first preferred embodiment according to the invention. The liquid feed containing the particles to be separated by flotation is prepared and conditioned with appropriate collector and frother reagents prior to entry to the vessel or column 1. For convenience it will be assumed that the vessel is a column with rotational symmetry about the vertical axis. The base of the column is a vertical cylindrical section 13, at the top of which an internal launder 14 is located. The feed to the column enters at the inlet 2, where it mixes with a supply of recycle liquid entering from a duct 11. The two streams combine and enter a distribution system 3 that feeds a multiplicity of entry pipes 4 into the base of the flotation cell. The total water flowrate is such that the superficial water velocity in the cell exceeds the minimum value required for fluidization. Air is introduced into the cell through a duct 5 from which it passes to a manifold 6 from which it splits to enter the fluidized bed through a multiplicity of small vertical pipes 7. At the upper end of the pipes the air stream forms small bubbles that detach and rise through the fluidized bed.

In the fluidized bed the particles are separated from each other and supported by the rising liquid, although the water volume fraction is not high, being of the order of 0.5 to 0.6. The gaps between the particles are in fact generally less than the diameters of the bubbles introduced through the inlet pipes 7, so as the bubbles rise in the fluidized bed they push the particles to one side and are thus brought into intimate contact with them. If the particles are hydrophobic there is a high probability of capture by bubbles, while the hydrophilic particles are not collected. At the top of the column 13 an interface 19 is formed between the fluidized bed and the liquid above. Particles 22 that are not attached to bubbles flow over the internal lip 20 and are removed from the vessel through the tailings discharge pipe 21. Bubbles rising out of the fluidized bed 18 pass into a relatively placid zone 30, carrying with them any hydrophobic particles that they have collected in the bed. The zone 30 acts as a settling zone in which particles of gangue that may have been entrained in the wake of the bubbles rising out of the fluidized bed, are able to fall back under gravity to the top of the bed 19. Bubbles with attached hydrophobic particles rise to the top of the column, passing into the froth layer 31 that is caused to form here. The froth flows over the upper lip 32 of the flotation cell, into a launder 33 from which it is discharged through a duct 34 as the flotation product. The depth of the froth layer 31 is maintained at an appropriate level by controlling the interface 35 by means not shown.

To maintain the fluidized bed 18, it is necessary that the water flowrate entering through the distribution pipes 4 is always sufficient to maintain the water superficial velocity in the bed above the minimum fluidization velocity. For practical reasons, this may not always be possible by solely relying upon the water contained in the fresh feed entering at 2. For example if there is a plant upset upstream of the flotation cell, the flow of new feed may cease altogether, or the water fraction in the feed may vary considerably. To overcome this problem, a liquid recycle stream is provided. A stream of liquid from the settling zone 30 above the fluidized bed is drawn through an opening 39 in the wall of the vessel and into a pipe 40 by the pump 41. The recycle stream, enters through the branch pipe 11 where it mixes with new feed entering through the duct 2, and proceeds to the manifold 3 and the distribution pipes 4. Because the recycle liquid is drawn from the settling zone above the fluidized bed, it is predominantly water.

It will be appreciated that air bubbles can be introduced into a fluidized bed of particles through a porous sparger, or entrained in the feed stream prior to discharge into the bed. However the use of the recycle stream adds extra flexibility to the operation of the fluidized bed, in that the flowrate of fluidizing liquid is essentially independent of the flowrate of feed liquid into the cell.

Figure 3:
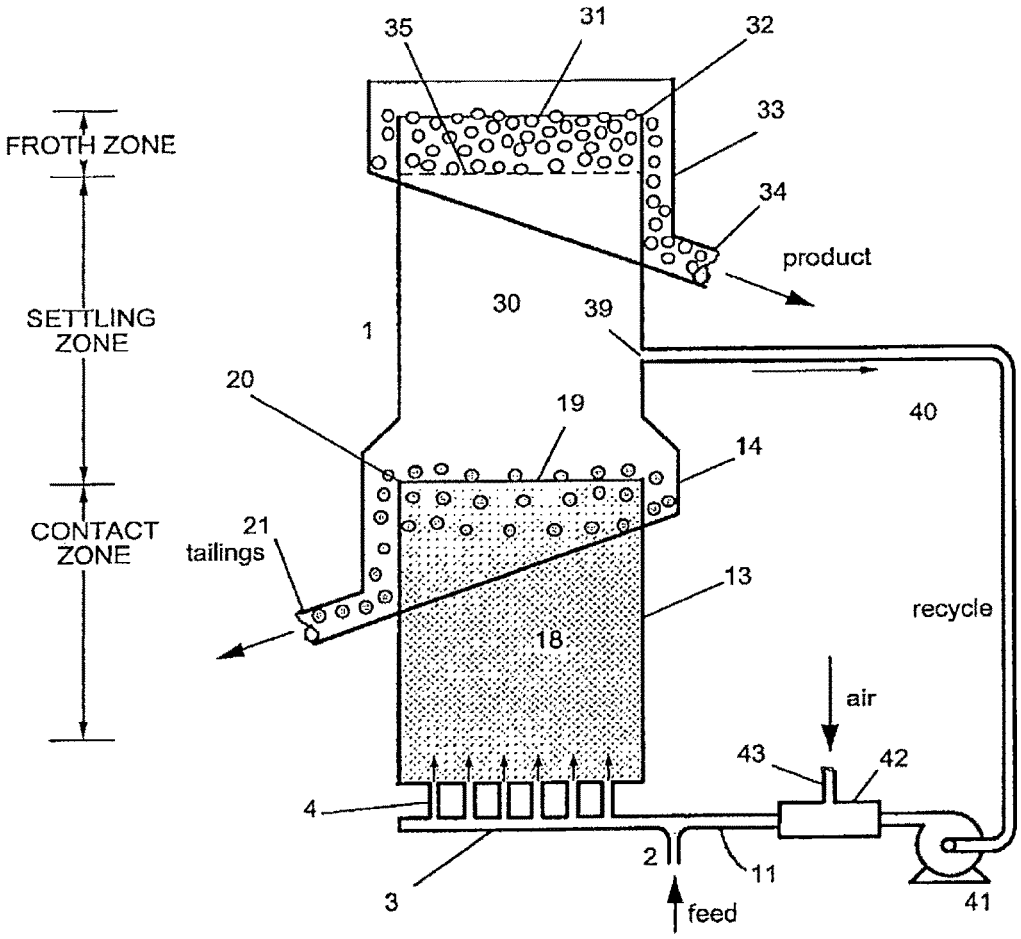
FIG. 3 is a schematic cross-sectional elevation similar to FIG. 1 including an aerated recycle stream.
Figure 4:
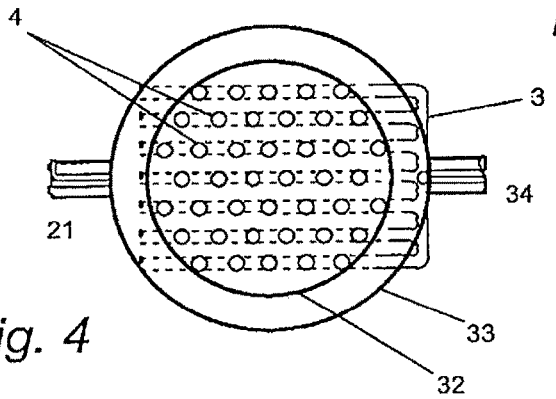
FIG. 4 is a cross-sectional plan view of FIG. 3, similar to FIG. 2.

A disadvantage of the small tubes 7 that are used to distribute the air into the fluidized bed, is that to form small bubbles, the internal diameter of these tubes must be very small, of the order of a millimeter or less, to make small bubbles. Tubes of such small dimensions will be prone to blockage by particles or corrosion products, and it would be advantageous if an alternative means were provided that was not so prone to blockage. In an alternative embodiment shown in FIG. 3 and FIG. 4, the recycle stream passes through a suitable aerator 42 where it mixes with a controlled supply of air that enters through the port 43. The aerator 42 may conveniently contain a sparger or in-line mixing device so as to disperse the air supply into the liquid in the form of small bubbles of a size convenient for flotation, prior to injection into the base of the column through the branch pipe 11. Alternatively, air bubbles could be sparged into the feed stream, or directly into the bed itself, but it is more advantageous to insert the air in the recycle line, whose flowrate can be controlled independently of the conditions in the fluidized bed.

Figure 5:
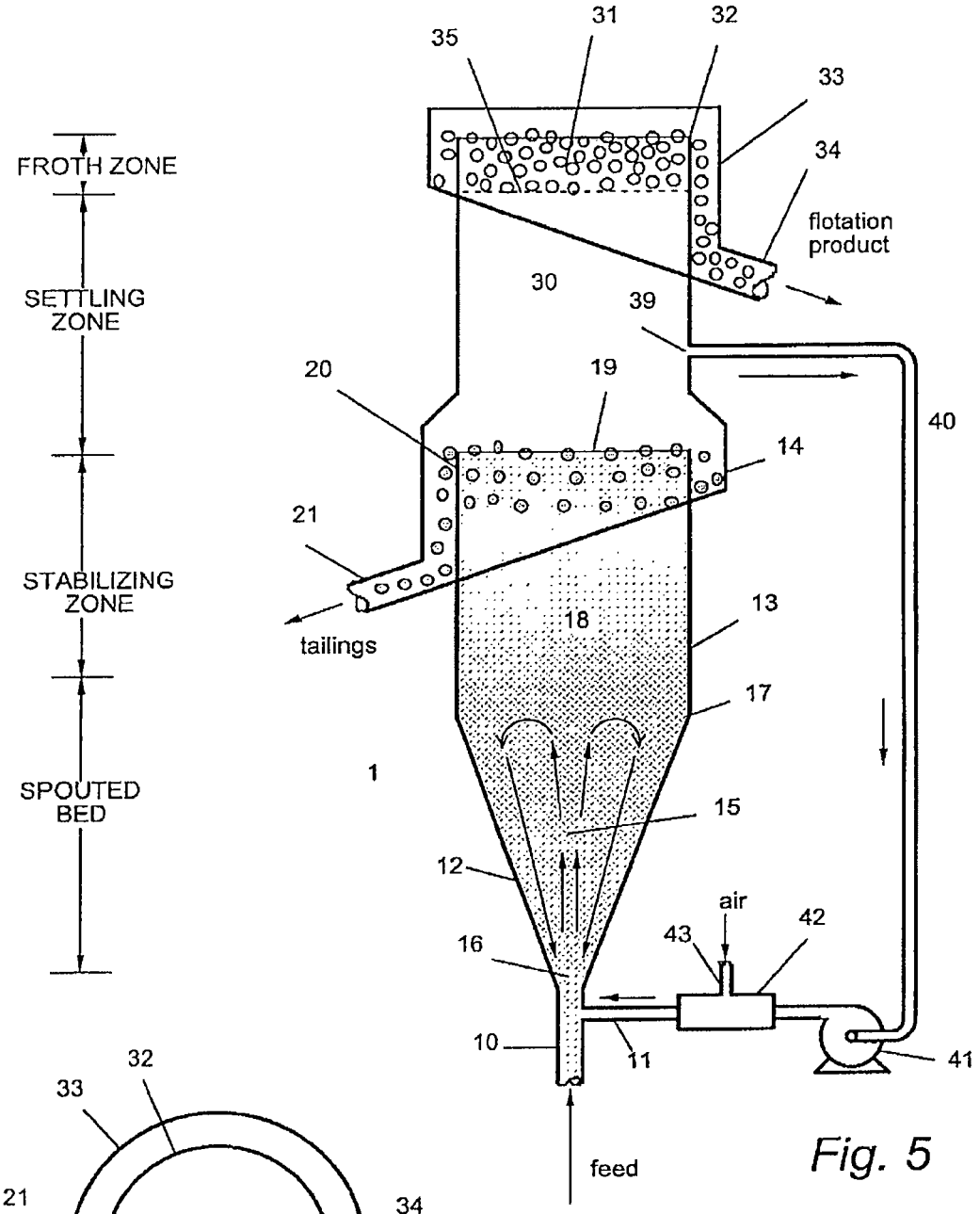
FIG. 5 is a schematic cross-sectional elevation similar to FIG. 1 but incorporating a spouted bed.
Figure 6:
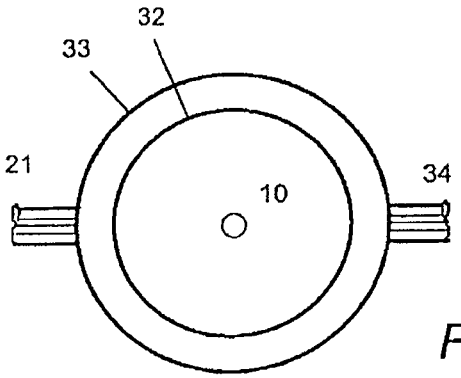
FIG. 6 is a cross-sectional plan view of FIG. 5, similar to FIG. 2.

In an alternative embodiment as shown in FIGS. 5 and 6, the liquid feed is conditioned with appropriate collector and frother reagents prior to entry to the vessel or column 1. For convenience it will be assumed that the column is a vessel with rotational symmetry about the vertical axis. The base of the column is of the form of an inverted cone 12, joined to a vertical cylindrical section 13, at the top of which an internal launder 14 is located. The feed to the column enters at the inlet 10, where it mixes with a supply of aerated recycle liquid entering from a duct 11. Both streams issue essentially in a vertical direction into the column, moving in combination with sufficient velocity to form a spouted fluidized bed 15 in the inverted cone 12. Particles and bubbles flow upwards in the core of the bed, and the momentum gradually diffuses radially outwards. A circulating flow pattern develops, in which particles from the fluidized bed are entrained into the feed jet in or near the entry region 16. They rise, carried by the energy in the jet. As the jet rises in the cone, its momentum is gradually transferred to the surrounding particles and liquid, and by the time the jet has reached the top of the cone 17, the entering energy is essentially distributed evenly across the cross-section of the fluidized bed, and above this point a uniform fluidized bed 18 forms. The particles entrained into the base of the spouted bed at 16 are replaced by other particles from the upper layers in the cell, that slide down the inside wall of the cone 12 to the entry region 15.

In the stabilizing zone above the cone, any turbulent bursts that may have been associated with the spouted bed are dissipated, and the bed has a calming influence on the flow. At the top of the parallel-sided column 13, an interface 19 is formed between the fluidized bed and the liquid above. Particles that are not attached to bubbles flow over the internal lip 20 and are removed from the vessel through the tailings discharge pipe 21. Bubbles rising out of the fluidized bed 18 pass into a relatively placid zone 30, carrying with them any hydrophobic particles that they have collected in the bed. In this zone, particles of gangue that may have been entrained in the wake of the bubbles rising out of the fluidized bed, are able to fall back under gravity to the top of the bed 19. Bubbles with attached hydrophobic particles rise to the top of the column, passing into the froth layer 31 that is caused to form here. The froth flows over the upper lip 32 of the flotation cell, into a launder 33 from which it is discharged through a duct 34 as the flotation product. The depth of the froth layer 31 is maintained at an appropriate level by controlling the interface 35 by means not shown.

To maintain the fluidized bed 18 above the minimum fluidization velocity, a stream of liquid from the settling zone 30 above the fluidized bed is drawn through an opening 39 in the wall of the vessel and into a pipe 40 by the pump 41, passing through a suitable aerator 42 where it mixes with a controlled supply of pressurized air that enters through the port 43. The aerator 42 may conveniently contain a sparger or in-line mixing device so as to disperse the air supply into the liquid in the form of small bubbles of a size convenient for flotation, prior to injection into the base of the column through the branch pipe 11. Alternatively, air bubbles could be sparged into the feed stream, or directly into the bed itself, but it is more advantageous to insert the air in the recycle line, whose flowrate can be controlled independently of the conditions in the fluidized bed.

Figure 7:
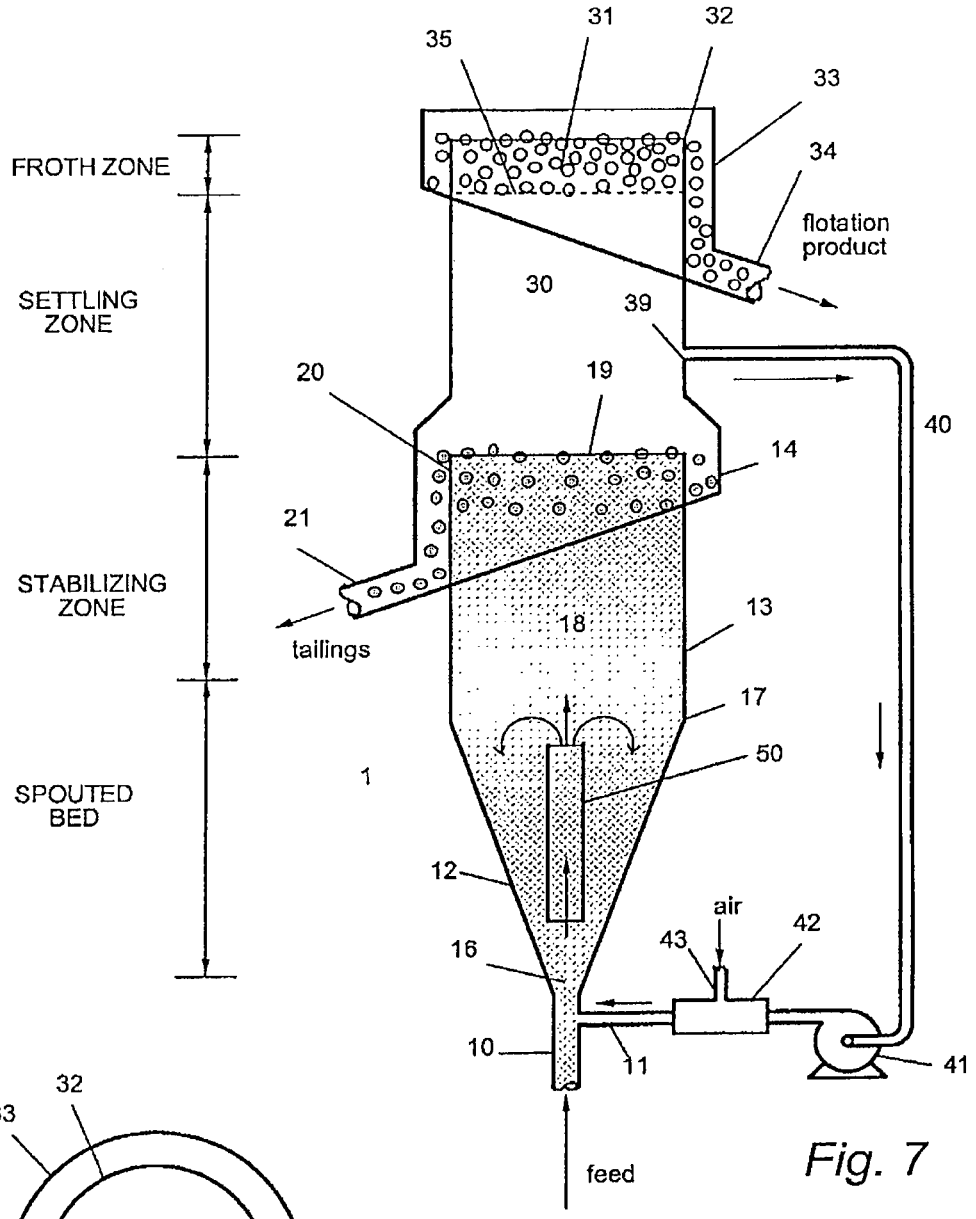
FIG. 7 is a schematic cross-sectional elevation, similar to FIG. 5 but incorporating a spouted bed with a draft tube.
Figure 8:
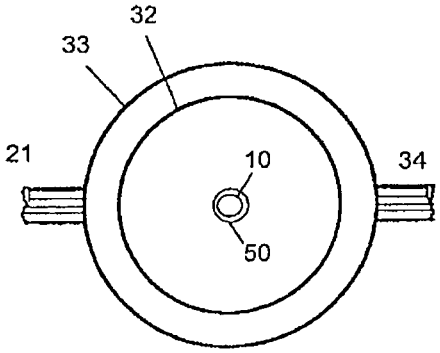
FIG. 8 is a cross-sectional plan view of FIG. 7, similar to FIG. 2.

Another embodiment of the invention is shown in cross-sectional elevation in FIG. 7 and in cross-sectional plan view in FIG. 8. In this embodiment, a draft tube 50 is mounted in the conical part of the flotation column shown in FIG. 5, to provide directional stability to the spouting jet. In some cases it is found that the jet is unstable and can move to one side or another within the column. The provision of a draft tube ensures that the rising flow driven by the momentum in the incoming jet and also by the buoyancy of the bubbles rising with the flow, is controlled and caused to rise along the axis of the column.

Figure 9:
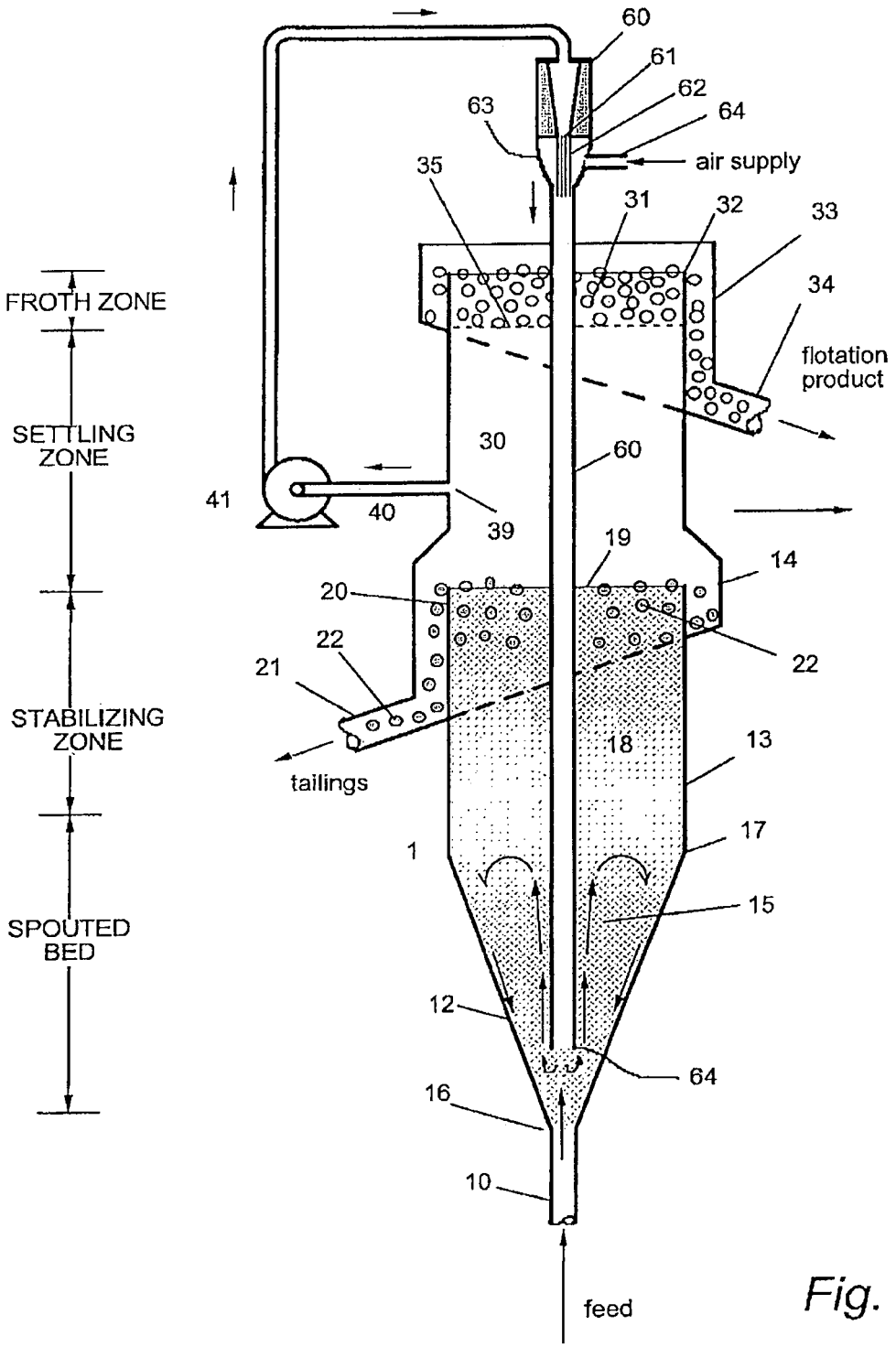
FIG. 9 is a schematic cross-sectional elevation, similar to FIG. 5 but showing an embodiment including a downcomer to introduce recycled liquid to the base of a spouted bed.

Another embodiment of the invention is shown in FIG. 9. A spouted fluidized bed is formed in the column 1 as previously shown in FIG. 5. A recycle stream from the settling zone 30 above the fluidized bed is drawn through an opening 39 in the wall of the vessel and into a pipe 40 by the pump 41, passing to the head of a downcomer 60. The downcomer shown in FIG. 9 consists of a duct that is essentially vertical, located co-axially with the flotation column 1. At the top of the downcomer, the feed is forced through a nozzle 61 to form a high-speed vertical jet of liquid 62 that enters a chamber 63 where is meets and mixes with a flow of air or other suitable gas that enters through a port 64. In the downcomer, the floatable particles in the recycle stream are brought into intimate contact with fine air bubbles created by the shearing action of the plunging jet, and the hydrophobic particles attach to the bubbles. The mixture of bubbles and feed slurry moves downwards through the downcomer 60, issuing at its lower end 64 into the base of the spouted bed 16, where it mixes with the feed slurry entering through the inlet 10. The combined flow of slurry and air bubbles then rises upwards, creating and maintaining the spouted bed 15. The ratio of the volumetric flowrate of air to the flowrate of recycle slurry is typically in the range 0.1 to 5, and more specifically 0.5 to 2, calculated at atmospheric pressure.

An advantage of the vertical downcomer 60 is that it is less likely that coarse particles of ore will be able to settle and accumulate within it. When the liquid contains large particles that settle quickly, aeration devices such as those shown in FIG. 5 may be prone to blockage or settling in the horizontal duct 11 leading to the base of the spouted bed 16, an effect that is exacerbated in the presence of air bubbles. It will be appreciated that other forms of downcomer of aeration tube are known and could be used in place of the downcomer shown here, provided the duct that delivers the aerated liquid stream to the base of the spouted bed is essentially vertical.

Figure 10:
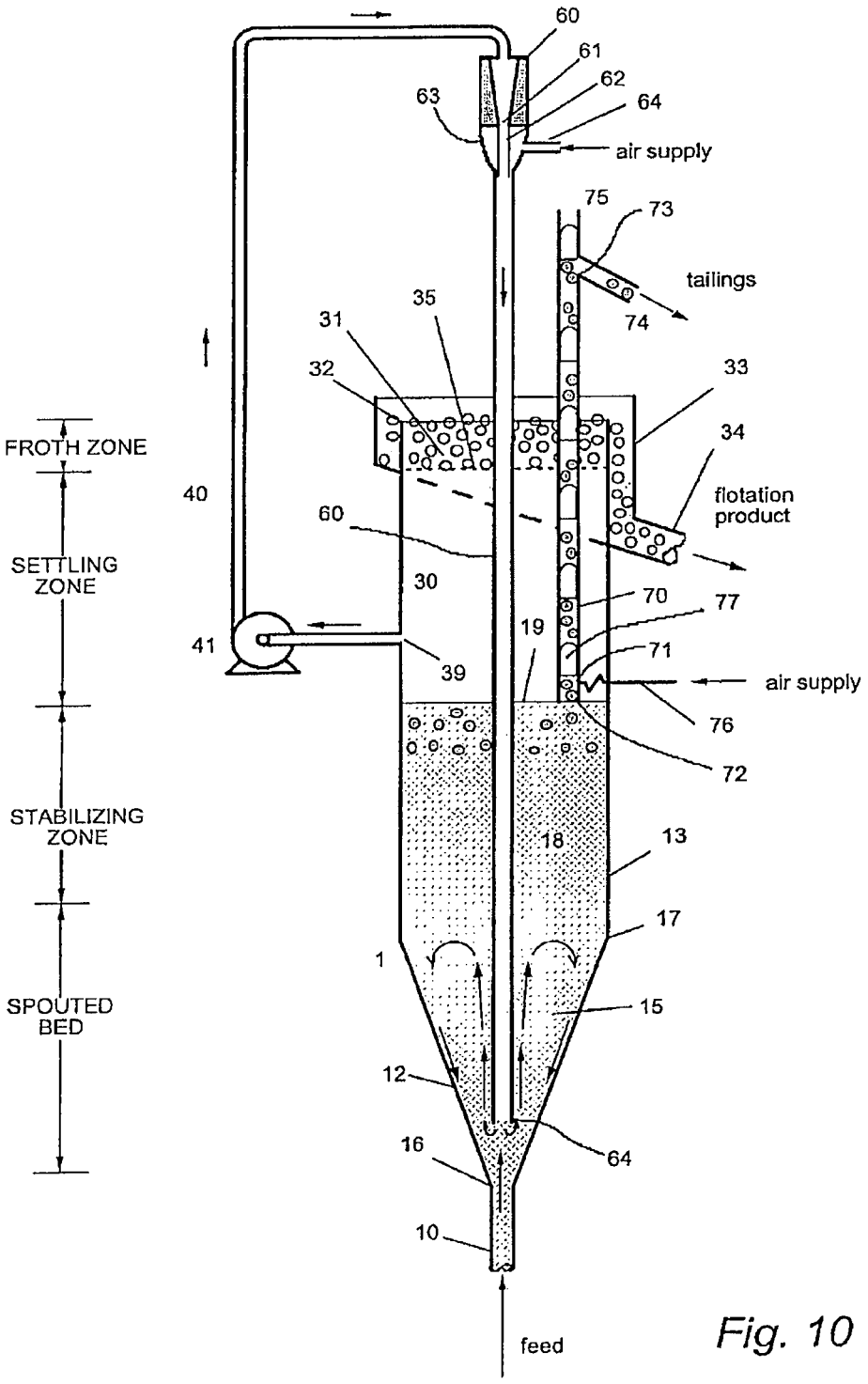
FIG. 10 is a schematic cross-sectional elevation, similar to FIG. 9 showing a spouted fluidized bed contacting device according to the invention incorporating an air lift pump for level control.

In the embodiments shown in FIGS. 1, 3, 5, 7 and 9, the fluidized tailings flow over an internal lip 20 and into the launder 14. The position of the lip 20 essentially defines the upper extent of the fluidized bed. However, as shown in the figures, the position of the lip 20 is fixed and may not easily be altered. An alternative method of withdrawing the tailings and maintaining the bed at a fixed height, that is applicable to any of the embodiments shown in the aforesaid FIGS. is shown in FIG. 10 by way of example. An air-lift pump is used to extract the fluidized tailings from the bed. It consists of a vertical duct 70 into which a stream of low-pressure air is blown through a convenient port 71. When air enters the duct 70, it disperses into bubbles 77 that rise upwards under gravity. Because of the difference in density between the slurry in the settling zone 30, and the aerated stream within the rising duct 70, a flow is established that forces the tailings upwards in the riser. The average density of the fluidized bed, which has a high solids content, is greater than that of the liquid in the settling zone 30. The interface 19 has similarities with the surface of a body of water exposed to the atmosphere. Thus the fluidized slurry flows towards the base 72 of the rising duct 70, thereby maintaining the height of the fluidized bed at a particular level. The slurry entrained with air bubbles in the riser 70 flows over the lip 73 and out of the vessel as tailings stream 74. The air bubbles disengage from the slurry stream and escape through the upper branch 75. The air lift pump has a number of advantages, being simple to construct and operate, and not prone to blockage by large particles in the tailings. The flow of air is adjusted relative to the area of the duct, so as to maintain the flow of tailings at a prescribed rate. A flow controller (not shown) that responds to a signal from a suitable device that senses the position of the upper surface of the fluidized bed, can be fitted to the air supply line 76. Thus an automatic control system can be installed that will maintain the height of the fluidized bed at a prescribed level, by varying the air flowrate as required. It will be appreciated that means other than an air lift pump could be used to extract tails slurry from the fluidized bed. However means such as slurry pumps do not have the inherent features of an air lift pump such as simplicity of operation and maintenance, and resistance to blockage by coarse particles.

An important feature of all embodiments of the invention is the creation of the stabilizing zone 18, which acts to eliminate turbulence that could otherwise cause bubble-particle aggregates to break up when rising in the settling zone 30. By operating the bed at fluidizing velocities that are only slightly above the minimum fluidization velocity, the channels in the bed are quite small, of the same order of magnitude as the diameter of the particles in the bed. Accordingly, the Reynolds number, which is an indicator of the turbulence levels in a fluid, is very small. The low-turbulence environment above the fluidized bed is very favourable to the transport of coarse particles from the bed and into the froth zone 31.

The use of the recycle fluid as a source of fluidizing water is an important advantage of the invention. If the only liquid available to fluidize the solid particles is the water in the feed, it would not be possible to provide stable operation of the column unless both the feed flowrate and the solids concentration in the feed were constant. The use of the recycle stream breaks the connection with the feed liquid. The flowrate of the recycle stream is independent of the feed flowrate, so if the flow to the column were to be shut off by a plant malfunction for example, the solids in bed could still be maintained in a fluidized state pending the re-starting of the plant, by maintaining the flow in the recycle stream.

In the embodiments of the invention shown in the drawings, the tailings stream, which contains the non-hydrophobic or hydrophilic particles, is drawn from the top of the fluidized bed. This has been done for convenience, because the means for removing the tailings—the overflow lip 20 or the lower extremity 70 of the air-lift pump—also serves to determine the height of the fluidized bed. However, it is possible to remove the tailings from a location within the fluidized bed, by providing an instrumented control system that consists of a means such as a float for detecting the position of the interface 19 between the fluidized bed and the settling zone; and a means for varying or controlling the flowrate of tailings from the flotation cell in response to signals from the interface level detecting device, so as to maintain the top of the fluidized bed at a desired level.

The fact that contacting is done in a fluidized bed has important implications for the solids concentration in the feed. At the point of incipient fluidization, the volume fraction of solids in a bed of granular particles is typically 0.6, so that if the density of the solids was taken to be 2800 $kg/m^3$, which is the density of siliceous gangue minerals often found in ores, the solids concentration on a weight basis would be 80 percent w/w, and the mass of water per unit mass of solids can be calculated to be 4.2 tonnes solids per tonne of water. As the water velocity is increased above the minimum required for fluidization, the solids volume fraction decreases, but a typical value in a fluidized bed would be 0.5, which corresponds to 2.8 tonnes solids per tonne of water. For flotation in conventional machines, the feed is usually prepared with a solids fraction of 35 percent w/w, for which the volume fraction is 0.54, and the mass of solids per unit mass of water is 0.538 tonnes solids per tonne of water. Such low solids fractions are required because of the difficulty of processing feeds of high volume fraction in known flotation technologies. However, with a fluidized bed, there is no point in preparing the feed at a low percent solids, because the properties of the bed itself will ensure that the solids fraction will increase, because of the slip between the particles and the fluid. Thus the solids content in the feed to the flotation cell could be increased to the same value as the solids fraction in the bed itself. In this case, the water required for the feed would be smaller by a factor of 2800/0.538 or 5.2. Thus the water needed for flotation would be reduced to only one-fifth, approximately, of the water required in conventional flotation machines. This is a very significant saving, especially in geographical areas where water is scarce.

In this manner the present invention is able to provide an improved froth flotation process in which flotation is carried out in a fluidized bed. The size range of particles that can be captured in flotation is able to be extended by an order of magnitude compared with current technologies while maintaining high capture efficiencies across the whole range of particles sizes in the feed. The invention is also able to provide a flotation process that leads to a reduction in water consumption in flotation.

The invention derives from an appreciation that the high levels of turbulence created in previous flotation technologies lead to a reduction in the efficiency of course particles by flotation. To reduce the levels of turbulence, a flotation environment is provided in which particles are captured by bubbles in a laminar flow in a fluidized bed. The flotation feed passes upwards through the bed, which is sufficiently deep to dampen out any turbulent eddies that may have been introduced into the flotation cell with the incoming feed slurry.

It is a feature of the invention that the flow field in the fluidized bed is very placid, and turbulence that is present in all previous technologies is eliminated. The flow conditions in the fluidized bed are highly conducive to the formation of stable avergates between bubbles and course particles. Bubbles carrying the particles to be separated rise through a settling zone where unwanted and trained particles are able to separate and fall back into the fluidized bed. The feed to the process can be at much higher solids content than previously known processes.

It is a further feature of the invention that a recycle stream is taken from the settling zone in the flotation cell above the fluidized bed and returned to the base of the fluidized bed as a means of maintaining the superficial velocity of water in the bed above the minimum required for fluidization.

The method and apparatus of the present invention provide numerous advantages including the ability to improve the flotation recovery of middling particles and particles of relatively large sizes, when compared with methods and apparatus of the prior art. Further, the process can operate at much higher solids concentrations than previous technologies, leading to significant savings in the water needed to prepare the feed for flotation.

What is claimed is:

1. Apparatus for separating selected hydrophobic particles from a mixture of particles in a fluid, said apparatus including:

a fluidization chamber arranged to receive a feed of a mixture of particles and fluid into the lower part of the chamber;

fluidization means arranged to supply bubbles and feed into the chamber at such a rate that a fluidized bed of particles is formed within the fluidization chamber;

a settling chamber located directly above and communicating with the fluidization chamber such that selected hydrophobic particles attached to bubbles rising to the top of the fluidized bed float upwardly within the settling chamber;

tailings separation means arranged to remove non-hydrophobic particles from the top of the fluidized bed; and an overflow launder at the top of the settling chamber arranged to remove the selected hydrophobic particles from a froth layer formed at the top of the flotation cell.

2. Apparatus as claimed in claim 1, wherein a recycle duct and pump is provided arranged to remove fluid from the settling chamber and recycle it with the feed into the lower part of the fluidization chamber.

3. Apparatus as claimed in claim 2, wherein an aerator is provided in the recycle duct, providing a source of bubbles into the feed.

4. Apparatus as claimed in claim 1, wherein the tailings separation means comprises an internal launder between the fluidization chamber and the settling chamber.

5. Apparatus as claimed in claim 1, wherein the tailings separation means comprises an air lift pump incorporating an uplift tube having its lower end located at the interface of the top of the fluidization chamber and the bottom of the settling chamber.

6. Apparatus as claimed in claim 1, wherein the lower end of the fluidization chamber is tapered inwardly and downwardly in the shape of an inverted cone, and the fluidization means include apparatus arranged to propel the feed upwardly from the apex of the inverted cone, forming a spouted jet within the lower part of fluidization chamber.

7. Apparatus as claimed in claim 6, wherein the fluidization chamber is provided with a vertically extending draft tube located just above the apex of the inverted cone and arranged to guide the spouted jet upwardly in a non-turbulent manner.

8. Apparatus as claimed in claim 1, wherein the lower end of the fluidization chamber is tapered inwardly and downwardly in the shape of an inverted cone, and the fluidization means include an apparatus arranged to supply the feed into the fluidization chamber at the apex of the inverted cone, and wherein bubbles are introduced into the lower part of the fluidization chamber by providing a downcomer extending downwardly through the settling chamber and the fluidization chamber to a point above the apex of the inverted cone, the upper end of the downcomer incorporating a nozzle and an air supply, the apparatus further including a duct arranged to remove fluid from the settling chamber and a pump arranged to pump fluid through that duct under pressure into the top end of the downcomer where the fluid is forced under pressure through the nozzle forming a downwardly plunging jet entraining air from the air supply and feeding the resultant bubbly mix downwardly through the downcomer to issue into the fluidized bed adjacent the apex of the inverted cone where it mingles with the feed.

* * * * *